United States Patent [19]

Ruger et al.

[11] 4,067,131

[45] Jan. 10, 1978

[54] FIRING MECHANISM FOR A REVOLVER

[75] Inventors: William B. Ruger, Southport; Harry H. Sefried, II, New Haven, both of Conn.

[73] Assignee: Sturm, Ruger & Co., Inc., Southport, Conn.

[21] Appl. No.: 776,632

[22] Filed: Mar. 24, 1977

[51] Int. Cl.[2] ..... F41C 19/00

[52] U.S. Cl. ..... 42/65; 42/66; 42/69 R

[58] Field of Search ..... 42/65, 66, 69 R, 69 B, 42/41, 59

[56] References Cited

U.S. PATENT DOCUMENTS

| | | | |
|---|---|---|---|
| 183,389 | 10/1876 | Freund | 42/65 |
| 255,241 | 3/1882 | Bled et al. | 42/65 |
| 391,156 | 10/1888 | Johnson et al. | 42/65 |
| 465,179 | 12/1891 | Johnson et al. | 42/65 |
| 811,807 | 2/1906 | Wesson | 42/65 |
| 933,797 | 9/1909 | Stone | 42/65 |
| 2,352,191 | 6/1944 | Garand | 42/69 B |
| 2,448,810 | 9/1948 | Koucky et al. | 42/69 B |
| 3,158,948 | 12/1964 | Freed | 42/65 |
| 3,245,167 | 4/1966 | Freed | 42/65 |
| 3,903,630 | 9/1975 | Dirstine | 42/65 |

*Primary Examiner*—Charles T. Jordan
*Attorney, Agent, or Firm*—Pennie & Edmonds

[57] ABSTRACT

A revolver having an essentially conventional hammer and trigger is provided with a main spring that combines the function of the separate hammer spring and trigger spring heretofore employed, the single main spring urging both the hammer and the trigger to their respective at-rest positions. A generally vertically disposed main spring lever is positioned rearwardly of the hammer and the trigger, the lower end of the main spring lever being pivotally mounted on the frame and the upper end being operatively connected to the hammer at a point below the pivot axis thereof. A generally horizontally disposed main spring is positioned between the trigger and the main spring lever, the forward end of the main spring being operatively connected to the trigger at a point below the pivot axis thereof and the rearward end of the spring being operatively connected to the main spring lever at a point intermediate the lower and upper ends thereof.

12 Claims, 6 Drawing Figures

FIRING MECHANISM FOR A REVOLVER

BACKGROUND OF THE INVENTION

1. Field of the Invention

This invention relates to revolvers, and in particular to revolvers having a main spring that combines the functions of separate hammer and trigger springs.

2. Prior Art

Conventional revolvers have a frame, a barrel, a cylinder rotatably mounted on the frame rearwardly of the barrel, a hammer pivotally mounted on the frame rearwardly of the cylinder, a trigger pivotally mounted on the frame below the hammer, a hammer spring urging the hammer to its forward or "at-rest" position, and a trigger spring urging the trigger to its forward or "at-rest" position. In a single action revolver the hammer and the trigger are formed with mutually engageable cam surfaces that cooperate to cause the trigger to be rotated from its at-rest position to its ready-to-fire position when the hammer is rotated from its at-rest position to its ready-to-fire position at which position the sear of the trigger engages the sear notch of the hammer to maintain the hammer at its ready-to-fire or cocked position. In a double action revolver the hammer and the trigger are also formed with mutually engageable cam surfaces, the cam surfaces cooperating to cause the hammer to be rotated from its at-rest position to its ready-to-fire position when the trigger is rotated from its-rest position to its ready-to-fire position at which position the trigger releases the hammer to allow the hammer to rotate forwardly under the pressure of the hammer spring and thus to strike a cartridge in the uppermost chamber of the cylinder of the revolver. The mutually engageable cam surfaces of the hammer and trigger of a double action revolver also cooperate to cause the trigger to be rotated from its at-rest position to its ready-to-fire position when the hammer is rotated from its at-rest position to its ready-to-fire position in the same manner as in the case of a single action revolver.

The hammer spring must be sufficiently strong to rotate the hammer forwardly from its ready-to-fire position to its fire position with sufficient force to strike and ignite the primer cap of a cartridge chambered in the revolver cylinder, and the trigger spring must be sufficiently strong to rotate the trigger forwardly from its ready-to-fire position to its at-rest position with sufficient force to overcome the friction and other mechanical forces that impede the return of the trigger to its at-rest position. When the revolver is fired in either its single action or double action mode the trigger and hammer are rotated from their at-rest positions to their ready-to-fire positions against the resistance of both the hammer spring and the trigger spring.

It has heretofore been proposed that the functions of the hammer spring and the trigger spring be combined in a single main spring that is positioned between mutually opposing points on the hammer and the trigger. If the single main spring has sufficient strength, when compressed, to cause the hammer to strike and fire a cartridge chambered in the revolver cylinder, it should have more than sufficient strength to rotate the trigger from its ready-to-fire to its at-rest position against whatever friction and other forces that may impede this movement. In effect, therefore, the need for a separate trigger spring has been eliminated and theoretically both the hammer pull and the trigger pull are reduced by the amount formerly required to compress the trigger spring. Moreover, the elimination of the trigger spring simplifies both the firing mechanism and the initial assembly thereof.

The positioning of a single main spring between mutually opposing points of the hammer and the trigger is effective to some extent in reducing the overall hammer pull or trigger pull required to cock and fire a revolver so equipped. However, the geometry of the parts involved and the space available therebetween has been found to limit the effectiveness of the use of a single main spring to replace the separate hammer and trigger spring. After an intensive investigation into this problem we have found that the effectiveness of the use of a single main spring to replace the separate trigger and hammer spring formerly employed is greatly enhanced by the provision of a generally vertically disposed main spring lever between the single main spring and the hammer. The main spring lever and the connecting linkage associated therewith permit a wide range of adjustments both in the mechanical advantage of the main spring and in the hammer pull and the trigger pull of the revolver. Moreover, our improved firing mechanism is characterized by the essential simplicity of its construction and by the use of a relatively few strongly proportioned parts in place of a greater number of somewhat smaller and less rugged parts.

SUMMARY OF THE INVENTION

The revolvers to which our improved firing mechanism relates have, among other parts, a frame, a cylinder rotatably mounted on the frame, a hammer pivotally mounted on the frame rearwardly of the cylinder, a trigger pivitally mounted on the frame below and forwardly of the hammer, and either a single main spring or two separate springs urging the hammer and the trigger to their respective at-rest positions. The hammer and the trigger have mutually engageable cam surfaces that cooperate to cause the hammer to be rotated from its at-rest position to its ready-to-fire position when the trigger is rotated from its at-rest position to its ready-to-fire position and to cause the trigger to be rotated from its at-rest position to its ready-to-fire position when the hammer is rotated from its at-rest position to its ready-to-fire position. The improved firing mechanism of the invention comprises a generally vertically disposed main spring lever positioned rearwardly of the hammer and the trigger, and a generally horizontally disposed main spring positioned between the trigger and the main spring lever. The lower end of the main spring lever is pivotally mounted on the frame and the upper end of the lever is operatively connected to the pivotally mounted hammer at a point thereon below the pivot axis thereof. The forward end of the main spring is operatively connected to the pivotally mounted trigger at a point thereon below the pivot axis thereof and the rearward end of the spring is operatively connected to the main spring lever at a point intermediate the lower and upper ends of the lever.

The main spring is advantageously mounted on a generally horizontally disposed main spring strut the forward end of which is pivotally connected to the trigger and the rearward end of which extends through an opening formed in the main spring lever. In one advantageous embodiment of the invention, the upper end of the main spring lever is connected to the hammer by means of a main spring lever connecting link the rearward end of which connecting link is pivotally connected to the upper end of the main spring lever and the forward end of which is pivotally connected to the hammer at a point below the pivot axis of the hammer. In another advantageous embodiment the upper end of the main spring lever is provided with a hammer engaging spur that contacts the hammer at a point thereon eccentric with respect to the pivot axis of the hammer. The hammer engaging spur of the main spring lever is maintained in contact with the hammer by the pressure of the main spring against the main spring lever, the main spring thereby urging the hammer to its at-rest position.

As hereinafter more fully explained, the improved firing mechanism of the invention provides much greater flexibility in the adjustment of the mechanical advantage of the main spring acting against both the hammer and the trigger as well as greater flexibility in the adjustment of both the hammer and trigger pull of the revolver than heretofore possible. For example, the energy or force with which the hammer and firing pin strike the primer of a cartridge chambered in the cylinder can be significantly increased while maintaining the trigger pull at an acceptably low level. Moreover, as previously mentioned, the firing mechanism is characterized by the simplicity of its construction and by the use of strongly proportioned parts therein.

BRIEF DESCRIPTION OF THE DRAWINGS

The improved firing mechanism of the invention will be better understood from the following description thereof in conjunction with the accompanying drawings of which.

DETAILED DESCRIPTION

Figure 1:
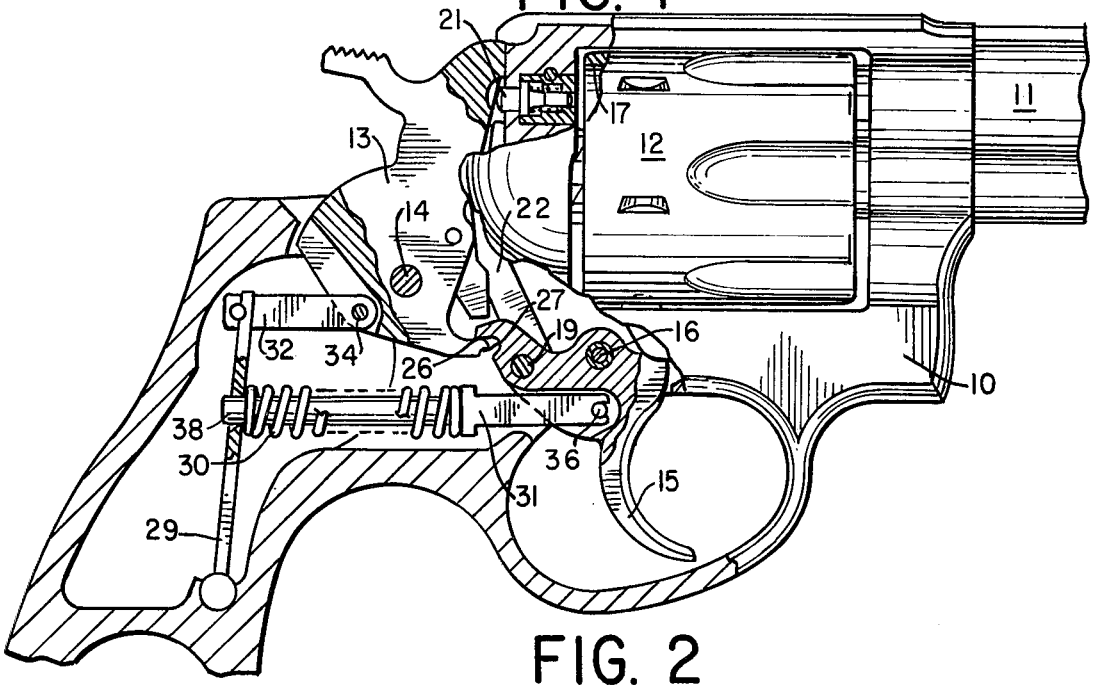
FIG. 1 is a fragmentary side elevation, partly broken away, of an advantageous embodiment of the firing mechanism showing the parts of the mechanism at their at-rest position.

The improved firing mechanism of the invention is applicable to both single action and double action revolvers of otherwise conventional design, as well as to other kinds of firearms having essentially the same type of firing mechanism as a revolver. The firing mechanism will be described in conjunction with the three double action revolvers shown in the drawings, although it is not limited to these specific revolvers.

Each of the revolvers shown in the drawings comprises, in its major components, a frame 10, a barrel 11 mounted on the frame, a cylinder 12 rotatably mounted on the frame rearwardly of the barrel, a hammer 13 pivotally mounted on the frame by means of the pivot pin 14, and a trigger 15 pivotally mounted on the frame by means of a pivot pin 16. As shown best in FIG. 1, the cylinder 12 is formed with a plurality of chambers 17 each adapted to receive a cartridge (not shown), and as shown best in FIG. 3, a cylinder pawl 18 is pivotally mounted on the trigger 15 by means of the pivot 19 for rotating the cylinder 12 an amount equal to the angular distance between each of the chambers 17 of the cylinder 12 when the trigger 15 is rotated to its ready-to-fire position. In the revolver shown in FIG. 1, a firing pin 21 is independently mounted on the frame 10 in position to strike a cartridge in the uppermost chamber of the cylinder 12 when the revolver is fired, and a transfer bar 22 is pivotally mounted on the trigger 15 and is moved upwardly between the hammer 13 and the firing pin 21 when the trigger 15 is rotated to its ready-to-fire position in the manner known in the art. In the revolver shown in FIG. 5, a firing pin 24 is mounted directly on the hammer 13 in position to strike a cartridge received in the uppermost chamber 17 in the cylinder 12 when the revolver is fired, the firing pin 24 normally being maintained out of contact with the cartridge by a safety mechanism hereinafter described.

The hammer and the trigger of both single action and double action revolvers are provided with mutually engageable cam surfaces that cooperate to cause the hammer and the trigger to rotate together from their respective at-rest positions to their ready-to-fire positions in the manner known in the art. The configuration of the mutually engageable cam surfaces of the hammer and trigger of a single action revolver differ somewhat from those of a double action revolver. However, the design of these mutually engageable cam surfaces is well known, and their cooperative action is well understood, by workers in this field, and in any case the specific design of these cam surfaces forms no part of the present invention.

Figure 2:
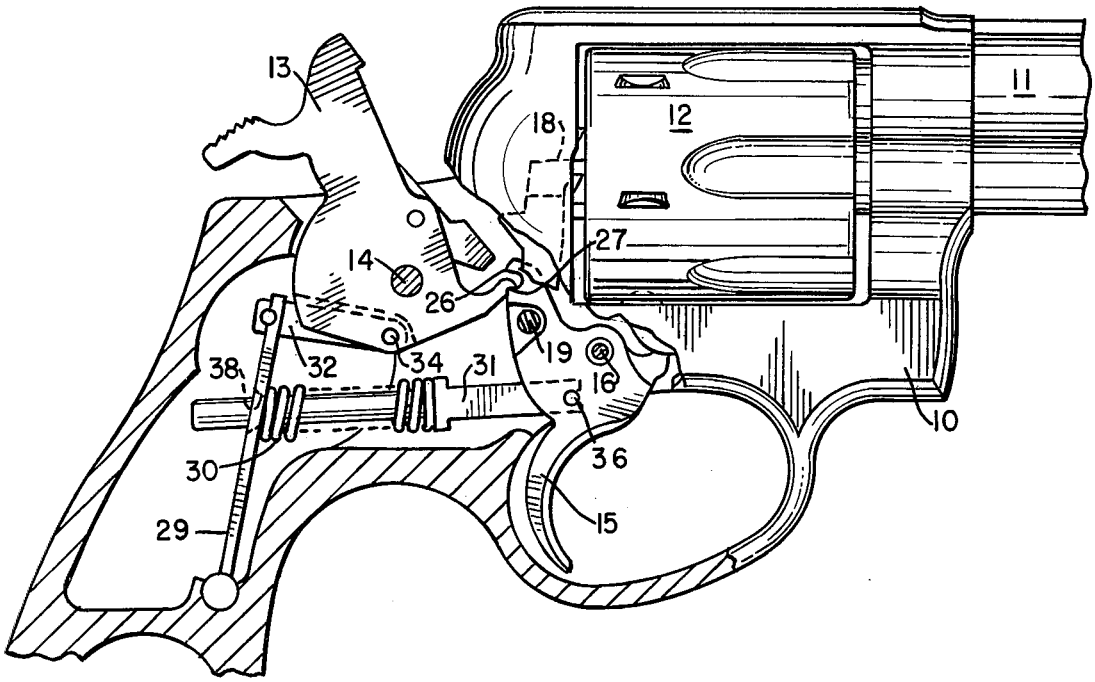
FIG. 2 is a fragmentary side elevation of the revolver of FIG. 1 showing the parts of the firing mechanism at their ready-to-fire position in the double action mode of firing.
Figure 3:
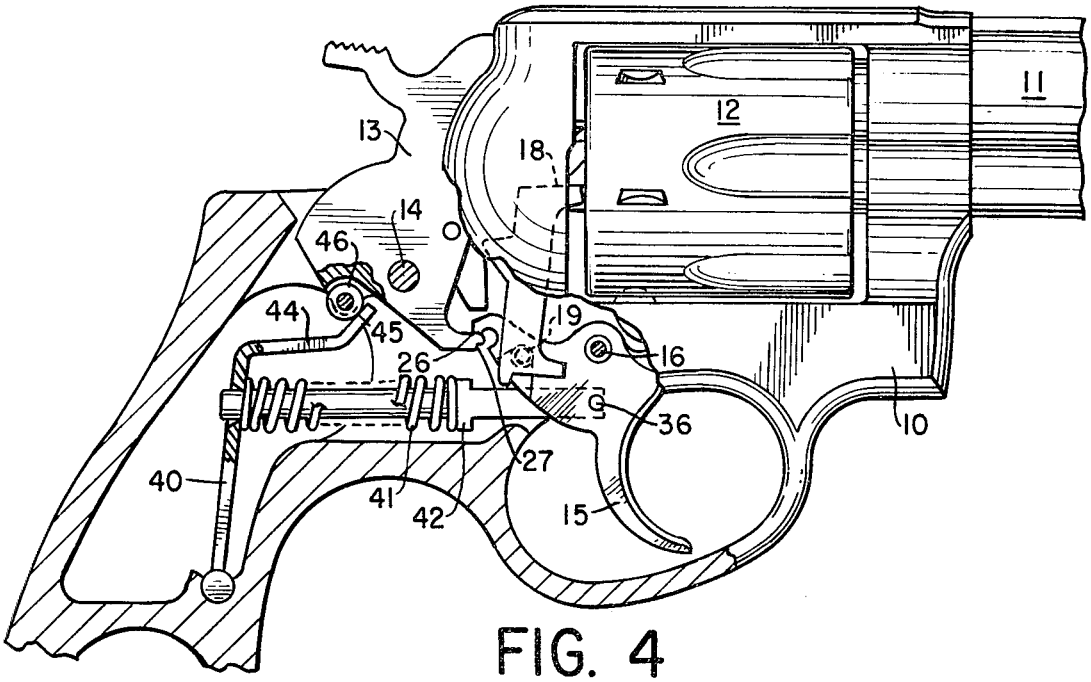
FIG. 3 is a fragmentary side elevation, partly broken away, of another advantageous embodiment of the firing mechanism showing the parts of the mechanism at their at-rest position.
Figure 4:
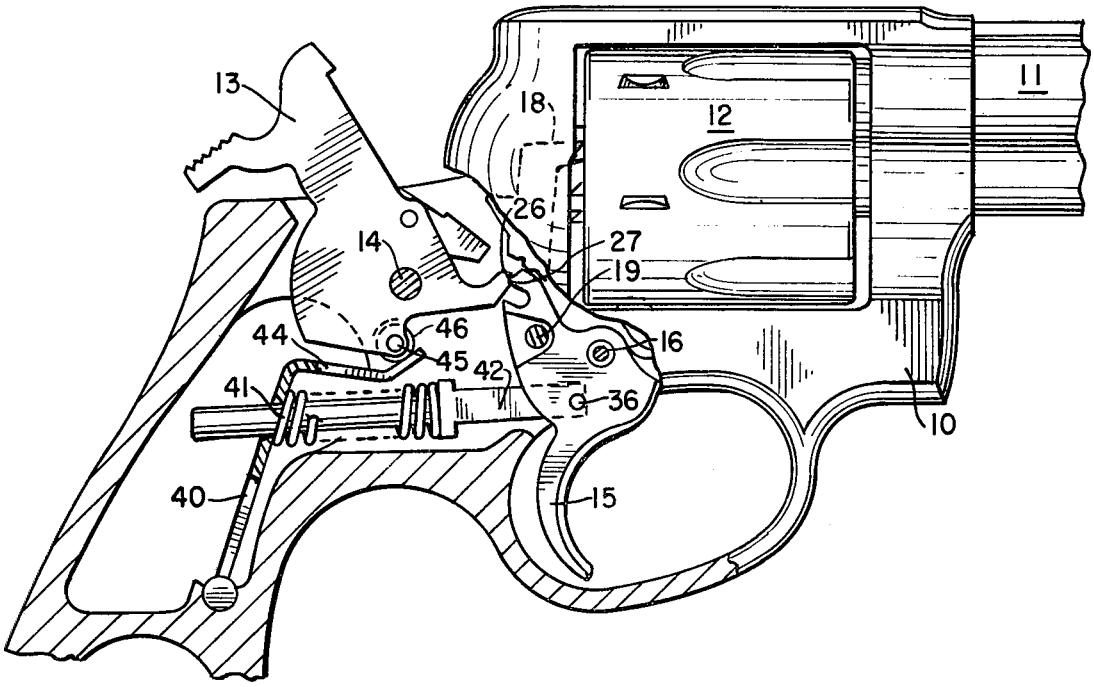
FIG. 4 is a fragmentary side elevation of the revolver of FIG. 3 showing the parts of the firing mechanism at their ready-to-fire position in the single action mode of firing.
Figure 5:
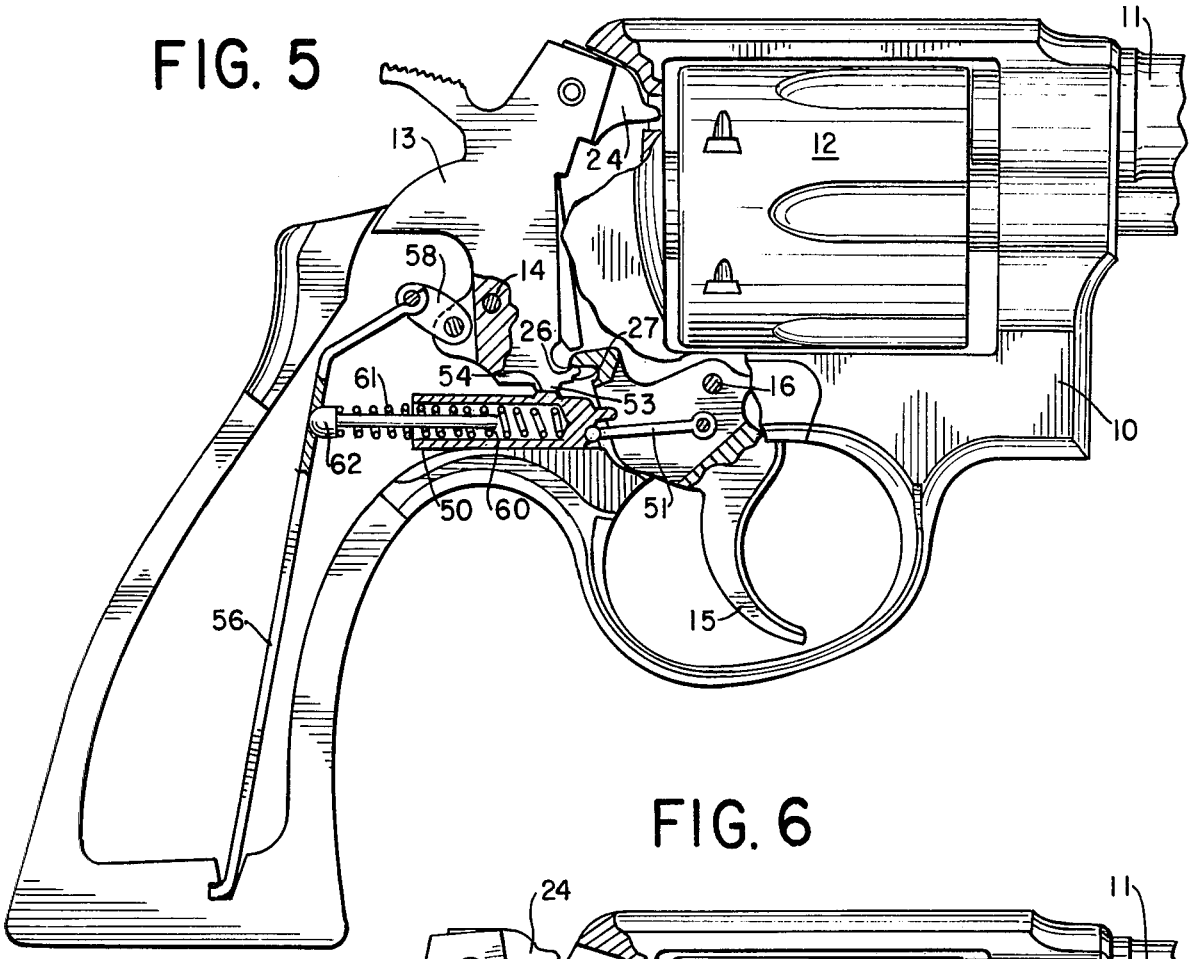
FIG. 5 is a fragmentary side elevation, partly in section, of yet another advantageous embodiment of the firing mechanism showing the parts of the mechanism at their at-rest position.
Figure 6:
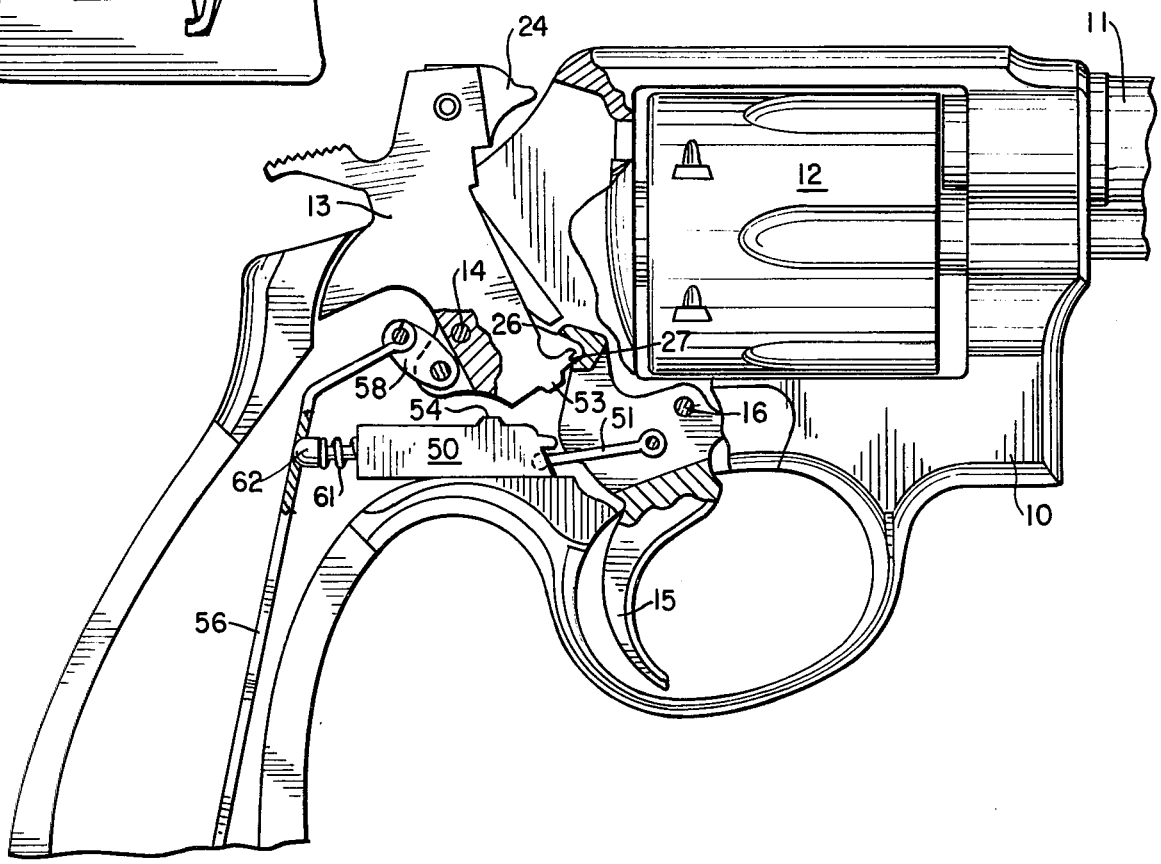
FIG. 6 is a fragmentary side elevation of the revolver of FIG. 5 showing the parts of the firing mechanism at their ready-to-fire position in the double action mode of firing.

When a double action revolver such as those shown in the drawings is fired in its double action mode of operation, the shooter manually pulls or rotates the trigger 15 from its at-rest position (as shown in FIGS. 1 and 5) to its ready-to-fire position (as shown in FIGS. 2 and 6) while at the same time the mutually engageable cam surfaces of the hammer 13 and the trigger 15 cooperate to cause the hammer 13 to be rotated from its at-rest position (as shown in FIGS. 1 and 5) to its ready-to-fire position (as shown in FIGS. 2 and 6). Further rotation of the trigger 15 causes the trigger to release the hammer 13 and thus allow the hammer to spring forwardly to fire the cartridge in the uppermost chamber 17 of the cylinder 12. When a double action revolver is fired in its single action mode of operation, the shooter manually rotates the hammer 13 from its at-rest position (as shown in FIG. 3) to its ready-to-fire position (as shown in FIG. 4) while at the same time the mutually engageable cam surfaces of the hammer 13 and the trigger 15 cooperate to cause the trigger 15 to be rotated from its at-rest position (as shown in FIG. 3) to its ready-to-fire position (as shown in FIG. 4). When the hammer 13 and the trigger 15 are at their ready-to-fire positions, the sear 26 of the trigger 15 engages the sear notch 27 of the hammer 15 and thus maintains the hammer at this position until the trigger is pulled by the shooter. When a single action revolver is fired, the sequence of operations and the relative movements of the hammer and the trigger are essentially the same as that which takes place when a double action is fired in its single action mode of operation.

Conventional revolvers are provided with separate hammer springs and trigger springs, and the resistance of both of these springs must be overcome when the revolver is fired, whether it is fired in its single action or its double action mode of operation. In the improved firing mechanism of the invention the separate hammer spring and trigger spring of the revolver are replaced by a single main spring that combines the functions of both former springs, thereby in effect eliminating one of the former springs (the trigger spring) and reducing by an equivalent amount the spring resistance that must be overcome when the revolver is fired. The single main spring of our improved firing mechanism is connected to both the hammer and the trigger by a system of levers and linkages that not only provides great flexibility in the adjustment of both the hammer pull and the trigger pull of the revolver, but in addition is characterized by the simplicity and ruggedness of its construction.

In the embodiment of the firing mechanism shown in FIGS. 1 and 2 of the drawings, a generally vertically disposed main spring lever 29 is positioned rearwardly of the hammer 13 and the trigger 15, and a generally horizontally disposed main spring 30 mounted on a main spring strut 31 is positioned between the trigger 15 and the main spring lever. The lower end of the main spring lever 29 is pivotally mounted on the frame 10 and the upper end of the main spring lever is operatively connected to the hammer 13 by means of a main spring lever connecting link 32. The rearward end of the connecting link 32 is pivotally connected to the main spring lever 29 and the forward end of the connecting link is pivotally connected to the hammer 13 at a point 34 below the axis of the pivot pin 14. The forward end of the main spring strut 31 is pivotally connected to the trigger 15 at a point 36 thereon below the axis of the pivot pin 16, and the rearward end of the main spring strut extends in telescopic fashion through an opening 38 formed in the main spring lever 29 at a point intermediate the upper and lower ends of the said lever.

When the revolver is fired in its double action mode, the trigger 15 is manually pulled rearwardly by the shooter, thereby causing both the trigger 15 and the hammer 13 to be rotated from the position of these parts shown in FIG. 1 to the position thereof shown in FIG. 2, this rotation of the trigger and the hammer, in turn, causing the main spring 30 to be compressed as also shown in FIG. 2. Further rotation of the trigger 15 causes the trigger to release the hammer, thus allowing the hammer to spring forwardly under the pressure of the main spring 30 to fire the cartridge in the uppermost chamber of the cylinder 12. The shooter then releases the trigger 15, thereby allowing the trigger to rotate forwardly under the residual pressure of the main spring 30 to its normal at-rest position. When the main spring 30 is compressed sufficient energy must be stored up therein to rotate the hammer 13 forwardly with sufficient force to ignite the primer cap of the cartridge and then to rotate the trigger 15 forwardly with sufficient force to overcome the friction and other mechanical impediments to the return of the trigger to its at-rest position. This requires a significant amount of effort on the part of the shooter. However, the effort required to compress the single main spring 30 of the firing mechanism of the present invention is appreciably less than that required to compress the separate hammer and trigger springs of conventional double action revolvers.

In the embodiment of the firing mechanism shown in FIGS. 3 and 4 of the drawing, a generally vertically disposed main spring lever 40 is positioned rearwardly of the hammer 13 and the trigger 15, and a generally horizontally disposed main spring 41 mounted on a main spring strut 42 is positioned between the trigger 15 and the main spring lever 40 as previously described. The upper end of the main spring lever 40 is provided with a forwardly extending hammer engaging spur 44 that contacts the hammer 13 at a point 45 thereon eccentric with respect to the axis of the pivot pin 14 of the hammer, the hammer engaging spur 44 of the main spring lever 40 being held in contact with the hammer 13 by the pressure of the main spring 41 thereagainst. To reduce friction between the hammer and the spur 44 a rotatable bearing element 46 is advantageously mounted on the hammer 13 at the pivot point 45 as shown in FIGS. 3 and 4 of the drawing.

When the revolver is fired in its double action mode, the trigger 15 is manually pulled rearwardly by the shooter to rotate the trigger 15 and the hammer 13 from their at-rest positions to their ready-to-fire positions and thereby compress the main spring 41 as described in connection with the embodiment of the firing mechanism as shown in FIGS. 1 and 2 of the drawings. When the trigger 15 releases the hammer 13 the hammer springs forwardly under the pressure of the main spring 41 to strike the cartridge in the uppermost chamber of the cylinder 12, and when the shooter releases the trigger 15 the pressure of the main spring 41 rotates the trigger forwardly to its at-rest position, as also previously described.

When the revolver is fired in its single action mode, the hammer 13 is manually pulled rearwardly by the shooter and both the hammer and the trigger 15 are rotated from the position of these parts shown in FIG. 3 to the position thereof shown in FIG. 4. When the hammer 13 and the trigger 15 reach their ready-to-fire positions, the sear 26 of the trigger engages the sear notch 27 of the hammer and thus maintains the hammer at its ready-to-fire or cocked position. The revolver is discharged by pulling the trigger 15 to move the sear 26 out of engagement with the sear notch 27, thereby allowing the hammer 13 to spring forwardly under the pressure of the main spring 41 to strike and fire the cartridge in the uppermost chamber of the cylinder 12. As before, rotation of the hammer 13 and the trigger 15 from their at-rest positions to their ready-to-fire positions compresses the main spring 41 and stores up sufficient energy in the spring to cause the hammer to strike the cartridge with sufficient force to ignite the primer cap thereof and then to rotate the trigger 15 forwardly to its normal at-rest position against the forces that impede free rotation of the trigger in this direction.

In the embodiment of the firing mechanism shown in FIGS. 5 and 6, the firing pin 24 is mounted directly on the hammer 13, the firing pin normally being held out of contact with a cartridge in the uppermost chamber of the cylinder 12 by the safety mechanism hereinbefore referred to. Specifically, a generally longitudinally disposed safety block 50 is slidably mounted on the frame 10 below the hammer 13, the forward end of the safety block 50 being pivotally connected to the trigger 15 by means of a safety block connecting link 51. The lower end of the hammer 13 is provided with a downwardly extending safety lug 53, and the upper surface of the safety block 50 is provided with an upwardly extending hammer block lug 54. When the hammer 13 and the trigger 15 are at their at-rest positions as shown in FIG. 5, the safety block 50 is at its forwardmost position with the safety lug 53 of the safety block in engagement with the hammer blocking lug 54 of the hammer 13. When the safety lug 53 of the hammer 13 is thus engaged by the hammer blocking lug 54 of the safety block 50, the hammer 13 is rotated a short distance rearwardly so that the firing pin 24 is safely out of contact with the primer cap of the cartridge in the uppermost chamber of the cylinder 12. When the hammer 13 and trigger 15 are rotated to their ready-to-fire positions as shown in FIG. 6, the safety block 50 is at its rearwardmost position where it cannot block or otherwise interfere with the forward rotation of the hammer 13. Therefore, when the hammer is released by the trigger 15 the hammer blocking lug 54 of the hammer block 50 cannot engage the safety lug 53 of the hammer 13 and thereby prevent the firing pin 24 from striking the cartridge in the cylinder 12. When the trigger 15 is released by the shooter and is allowed to return to its normal at-rest position, the safety block 50 is returned to its forwardmost position at which position the hammer blocking lug 54 thereof re-engages the hammer safety lug 53 of the hammer 13, thereby moving the hammer and the firing pin 24 rearwardly out of contact with the cartridge in the chamber 12.

The generally vertically disposed main spring lever 56 is positioned rearwardly of the hammer 13 and the trigger 15, the lower end of the main spring lever being pivotally mounted on the frame 10 and the upper end thereof being pivotally connected to the hammer 13 by means of the main spring lever connecting link 58. The forward end of the safety block 50 is pivotally connected to the trigger 15 by means of the safety block connecting link 51, and the rearward end of the safety block is formed with a rearwardly facing main spring receiving recess 60. The forward end of the main spring 61 is received in the main spring receiving recess 60 of the safety block 50, and the rearward end of the main spring 61 is mounted on a plunger 62 that contacts the main spring lever 56 at a point thereon intermediate the upper and lower ends thereof.

When the revolver is fired in its double action mode, the trigger 15 is manually pulled rearwardly by the shooter, thereby causing the trigger 15, the hammer 13 and the safety block 50 to be moved from the position of these parts shown in FIG. 5 to the position thereof shown in FIG. 6, this rotation of the trigger and the hammer, in turn, causing the main spring 61 to be compressed as also shown in FIG. 6. Further rotation of the trigger 15 causes the trigger to release the hammer 13 and allows it and the firing pin 24 to spring forwardly under the pressure of the main spring 61 to fire the cartridge in the uppermost chamber of the cylinder 12. The shooter then releases the trigger 15, thereby allowing the trigger 15 and the safety block 50 to be moved forwardly by the main spring 61 to their respective at-rest positions as shown in FIG. 5.

The improved firing mechanism of the invention is characterized by the simplicity and strength of its construction. Moreover, the arrangement of the trigger, main spring, main spring lever and hammer relative to each other provides great flexibility in the adjustment of the force exerted by the main spring against both the trigger and the hammer, and this can result in an appreciable reduction in the hammer pull and the trigger pull of the revolver without any loss in the reliability of the mechanism, or it can result in an increase in the force with which the hammer strikes the cartridge while maintaining the trigger pull at an acceptable level.

We claim:

1. In a revolver having a frame, a cylinder rotatably mounted on the frame, a hammer pivotally mounted on the frame rearwardly of the cylinder, a trigger pivotally mounted on the frame below and forwardly of the hammer, and a main spring urging the hammer and the trigger to their respective at-rest positions, said hammer and said trigger having mutually engageable cam surfaces that cooperate to cause the hammer to be rotated from its at-rest position to its ready-to-fire position when the trigger is rotated from its at-rest position to its ready-to-fire position and to cause the trigger to be rotated from its at-rest position to its ready-to-fire position when the hammer is rotated from its at-rest position to its ready-to-fire position, the improvement which comprises a generally vertically disposed main spring lever positioned rearwardly of the hammer and the trigger the lower end of which lever is pivotally mounted on the frame and the upper end of which lever is operatively connected to the pivotally mounted hammer at a point thereon below the pivot axis thereof, and a generally horizontally disposed main spring positioned between the trigger and the main spring lever the forward end of which spring is operatively connected to the pivotally mounted trigger at a point thereon below the pivot axis thereof and the rearward end of which spring is operatively connected to the main spring lever at a point intermediate the lower and upper ends of said lever.

2. The revolver according to claim 1 in which the main spring is mounted on a generally horizontally disposed main spring strut the forward end of which is pivotally connected to the trigger and the rearward end of which extends through an opening formed in the main spring lever.

3. The revolver according to claim 1 in which the upper end of the main spring lever is operatively connected to the hammer by means of a main spring lever connecting link the rearward end of which connecting link is pivotally connected to the upper end of the main spring lever and the forward end of which connecting link is pivotally connected to the hammer at a point below the pivot axis thereof.

4. The revolver according to claim 1 in which the upper end of the main spring lever is provided with a hammer engaging spur that contacts the hammer at a point eccentric with respect to the pivot axis of the hammer, said hammer engaging spur being maintained in contact with the hammer by the pressure of the main spring against the main spring lever that urges the hammer to its at-rest position.

5. The revolver according to claim 4 in which the hammer is provided with a rotatably mounted bearing that is contacted by the hammer engaging spur of the main spring lever.

6. The revolver according to claim 1 in which a generally longitudinally disposed safety block is slidably mounted for longitudinal movement on the frame below the hammer, said safety block maintaining the hammer out of contact with a cartridge chambered in the cylinder of the revolver when the safety block is at its forwardmost position, in which the forward end of the main spring is operatively connected to the longitudinally movable safety block, and in which the trigger is operatively connected to the forward end of the safety block so that movement of the trigger from its at-rest position to its ready-to-fire position causes the safety block to move longitudinally rearwardly against the pressure of the main spring.

7. The revolver according to claim 6 in which the safety block is formed with a rearwardly facing recess in which recess the forward end of the main spring is received, and in which the rearward end of the main spring is mounted on a plunger that contacts the main spring lever at a point intermediate the upper and lower ends thereof.

8. In a revolver having a frame, a cylinder rotatably mounted on the frame, a hammer pivotally mounted on the frame rearwardly of the cylinder, a trigger pivotally mounted on the frame below and forwardly of the hammer, and a main spring urging the hammer and the trigger to their respective at-rest positions, said hammer and said trigger having mutually engageable cam surfaces that cooperate to cause the trigger to be rotated from its at-rest position to its ready-to-fire position when the hammer is rotated from its at-rest position to its ready-to-fire position, the improvement which comprises a generally vertically disposed main spring lever positioned rearwardly of the hammer and the trigger the lower end of which lever is pivotally mounted on the frame and the upper end of which lever is operatively connected to the pivotally mounted hammer at a point thereon below the pivot axis thereof, and a generally horizontally disposed main spring positioned between the trigger and the main spring lever the forward end of which spring is operatively connected to the pivotally mounted trigger at a point thereon below the pivot axis thereof and the rearward end of which spring is operatively connected to the main spring lever at a point intermediate the lower and upper ends of said lever.

9. The revolver according to claim 8 in which the main spring is mounted on a generally horizontally disposed main spring strut the forward end of which is pivotally connected to the trigger and the rearward end of which extends through an opening formed in the main spring lever.

10. The revolver according to claim 8 in which the upper end of the main spring lever is operatively connected to the hammer by means of a main spring lever connecting link the rearward end of which connecting link is pivotally connected to the upper end of the main spring lever and the forward end of which connecting link is pivotally connected to the hammer at a point below the pivot axis thereof.

11. The revolver according to claim 8 in which the upper end of the main spring lever is provided with a hammer engaging spur that contacts the hammer at a point eccentric with respect to the pivot axis of the hammer, said hammer engaging spur being maintained in contact with the hammer by the pressure of the main spring against the main spring lever that urges the hammer to its at-rest position.

12. The revolver according to claim 8 in which a generally longitudinally disposed safety block is slidably mounted for longitudinal movement on the frame below the hammer, said safety block maintaining the hammer out of contact with a cartridge chambered in the cylinder of the revolver when the safety block is at its forwardmost position, in which the forward end of the main spring is operatively connected to the longitudinally movable safety block, and in which the trigger is operatively connected to the forward end of the safety block so that movement of the trigger from its at-rest position to its ready-to-fire position causes the safety block to move longitudinally rearwardly against the pressure of the main spring.

* * * * *